United States Patent [19]

Desio et al.

[11] 4,028,515

[45] June 7, 1977

[54] SPRING CONTACT SWITCH FOR DUAL IN LINE MULTIPLE SWITCH ASSEMBLY HAVING MOMENTARY ACTUATED LIGHTED INDICATORS

[75] Inventors: Frank B. Desio, Melrose Park; Samuel Lee Webb, Lisle, both of Ill.

[73] Assignee: Illinois Tool Works Inc., Chicago, Ill.

[22] Filed: Sept. 15, 1975

[21] Appl. No.: 613,696

[52] U.S. Cl. ..... 200/276; 200/5 A; 200/159 R; 200/279

[51] Int. Cl.[2] ..... H01H 13/32; H01H 1/06

[58] Field of Search ..... 200/276, 5 A, 159 A, 200/159 B, 275, 279, 310, 314, 317, 159 R

[56] References Cited

UNITED STATES PATENTS

| | | | |
|---|---|---|---|
| 2,788,420 | 4/1957 | Mathews et al. | 200/279 |
| 3,179,777 | 4/1965 | Rohacs | 200/317 |
| 3,388,229 | 6/1968 | Lyvang | 200/279 X |
| 3,699,296 | 10/1972 | Harris | 200/276 X |
| 3,725,625 | 4/1973 | Pratt | 200/159 R |
| 3,743,798 | 7/1973 | Pentecost | 200/159 R X |
| 3,842,230 | 10/1974 | Kashio et al. | 200/276 |
| 3,863,040 | 1/1975 | Van Benschoten et al. | 200/276 X |
| 3,934,105 | 1/1976 | Lockard | 200/317 |
| 3,979,571 | 9/1976 | Van Benschoten | 200/276 X |

*Primary Examiner*—James R. Scott
*Attorney, Agent, or Firm*—Glenn W. Bowen; Robert W. Beart

[57] ABSTRACT

A dual-in-line switch package having a plurality of momentary contact switching stations and a plurality of indicating lights is disclosed. The switching mechanism of the switches is provided by a close wound coil spring having one end that encloses one contact and another end that is bent by the depression of a pushbutton so that it makes contact with a second contact in order to complete the circuit. The indicating lights may be light-emitting diodes which have lead extensions that are brought out of the package in line with the contacts for the switches. The light-emitting diodes rest on a support guide rail and are held in place in the switch when the cover is snapped on.

3 Claims, 12 Drawing Figures

18
72
12
64
66
80
15
13
34
28
32
14
30
40
36
22
7
38
102
42
44
48
50
46
52
49
56
58
54
60
62
74
76
68
70
100
82
92
93
90
84
78
95
103
98
86
96
88
105
106
94
104

SPRING CONTACT SWITCH FOR DUAL IN LINE MULTIPLE SWITCH ASSEMBLY HAVING MOMENTARY ACTUATED LIGHTED INDICATORS

BACKGROUND OF THE INVENTION

Dual-in-line switch packages with a plurality of switching stations for use on integrated circuit boards are difficult to manufacture because of the extremely small size required of the switches. For example, the illustrated embodiment of the switch of the present invention incorporates five momentary contact switches and four light-emitting diode indicators, in a switch which is on the order of 1.0 inches × 0.3 inches × 0.4 inches. Because of the small size of such switches, it is extremely difficult to provide both a plurality of reliable switches and a plurality of satisfactory indicators in them. With extremely small switch packages like this, there is always the danger of having a constantly closed contact which could cause serious problems when the switches are used as program switches for data processing equipment. The switch of the present invention provides a reliable switching mechanism which utilizes a minimum of space, and which allows for the inclusion of an indicating device, such as a light-emitting diode, that has a size sufficient to provide a satisfactory indication which may be easily viewed.

DESCRIPTION OF THE DRAWINGS

The present invention is illustrated by reference to the drawings in which.

TECHNICAL DESCRIPTION OF THE INVENTION

Figure 1:
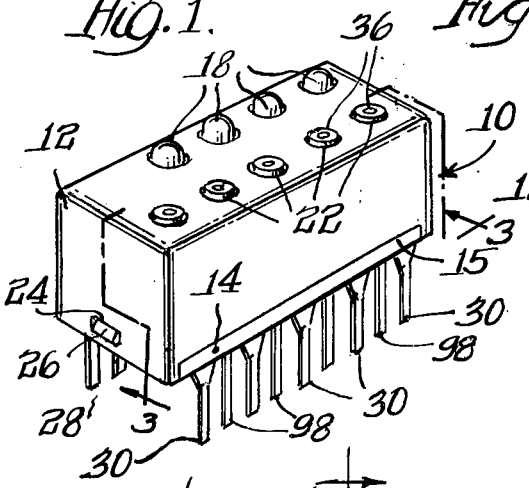
FIG. 1 is a perspective view of an assembled dual-in-line switch package which is constructed in accordance with the present invention.
Figure 2:
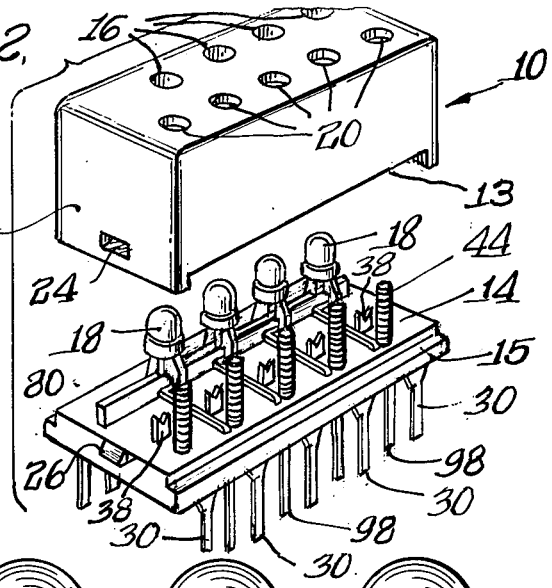
FIG. 2 is a perspective view of the switch package of FIG. 1 with the cover removed and the pushbuttons not shown.
Figure 3:
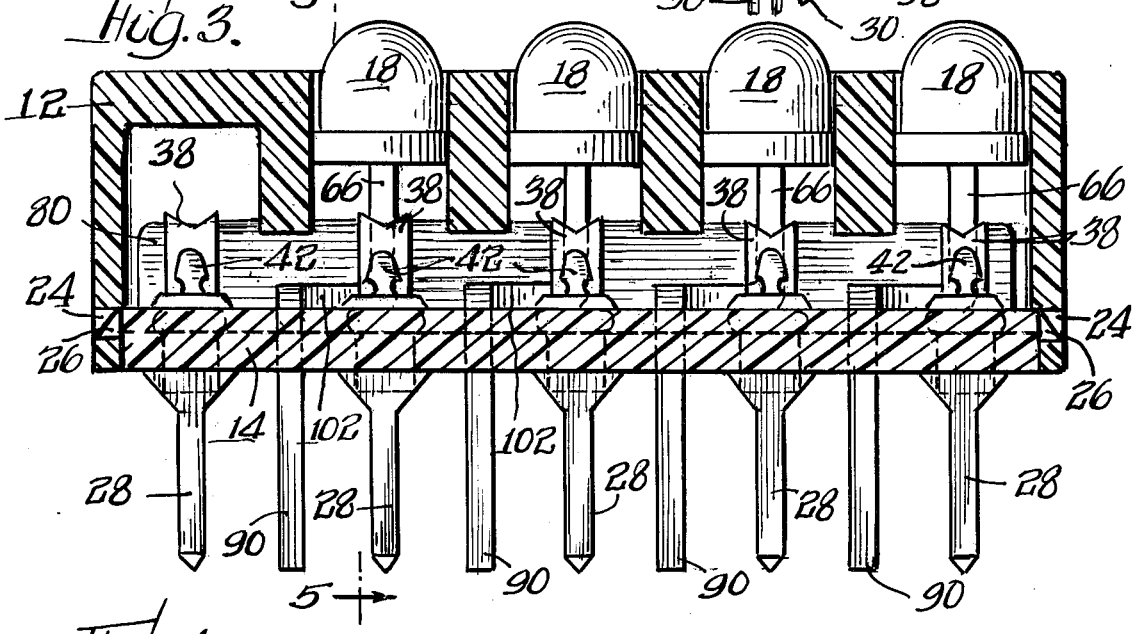
FIG. 3 is a cross-sectional view of the switch package of FIG. 1 taken along the lines 3—3 of FIG. 1.
Figure 4:
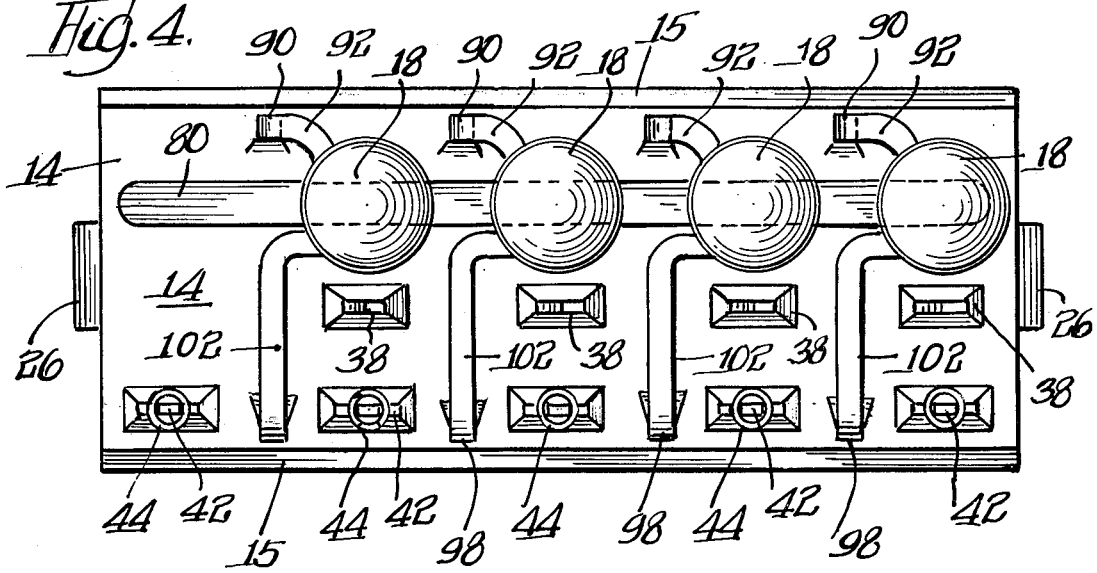
FIG. 4 is a top view of the switch package of FIG. 2 with the top cover removed.
Figures 5, 6, 7, 8:
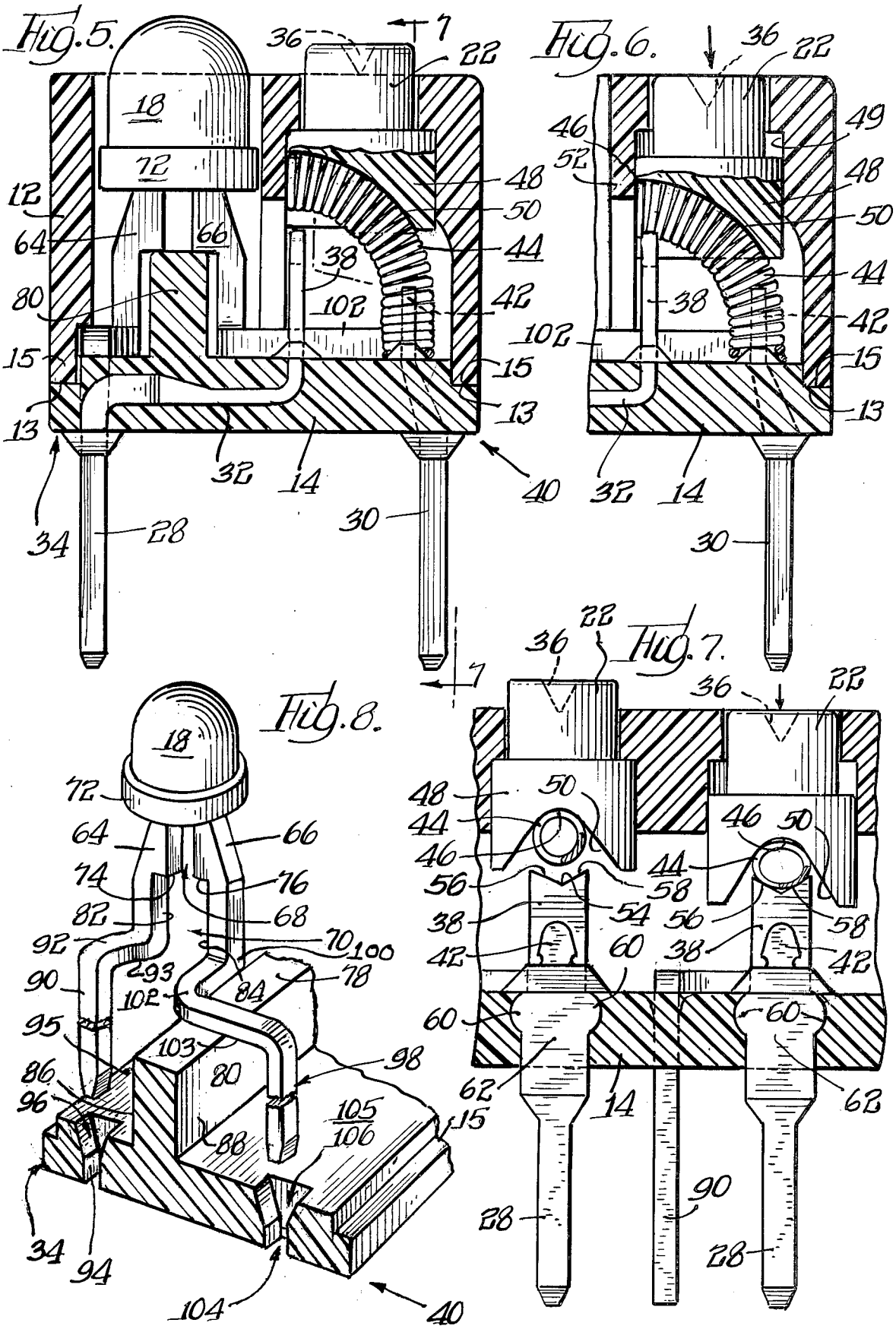
FIG. 5 is a cross-sectional view of a single switching mechanism and an indicating light taken along the lines 5—5 of FIG. 3.
FIG. 6 is a partial cross-sectional view which shows one switching station with the pushbutton depressed and the switch in an actuated condition.
FIG. 7 is an enlarged view of two switching stations of the switch package of FIG. 3, one of which is an unactuated station and the other of which is an actuated station.
FIG. 8 is an enlarged perspective view that shows one light-emitting diode indicator that is supported on a rail which is integrally formed on the base of the switch package of FIG. 1.

A dual-in-line switch package constructed in accordance with the present invention is represented by the general designation 10 in FIG. 1. The switch package 10 consists of a cover 12 and a base section 14. The cover 12 is provided with a first row of apertures 16, each of which receives a light-emitting indicator and with a second row of apertures 20, each of which receives a pushbutton 22 for a switching station. The pushbuttons 22 have a small recess 36 in them so that they may be actuated by the point of a pencil or a ball point pen rather than by a finger, if desired, because of the small size of the switch package and pushbutton. The cover 12 also has a pair of rectangular shaped openings 24 which mate with a pair of extending protrusions 26 on the base 14 in order to hold the cover 12 in place. The bottom surface 13 of the cover 12 engages the ledge 15 of the base 14, as shown in FIG. 5. In the illustrated embodiment, four light-emitting diodes 18 and five momentary switching stations are employed.

As shown in FIG. 5, each switching station consists of a pair of contact members 28, 30. The contect member 28 passes through a channel 32 in the base 14 from a point near one edge 34 of the switch package 10 to approximately the middle of the base 14, at which point the contact portion 38 extends upwardly. The contact member 30 passes through the base 14 generally straight upwardly near the edge 40, which is substantially parallel to the edge 34, to a contact portion 42. The lower end of a close wound coil spring 44 is inserted over the contact portion 42, with the upper end of the spring 44 engaging the bottom 48 of a pushbutton 22. The use of a coil spring in a switching mechanism, as opposed to a leaf spring, allows greater deflection at lower stresses, and consequently provides an extremely durable spring element. The bottom 48 of the pushbutton 22 has a curved cam surface 50 which, when the switch is in its undepressed condition, engages the upper end of the spring 44, as shown in FIG. 5, in which the upper end of the spring is shown as being bent slightly toward the contact portion 38. This initial cocking of the spring 44 allows the operating force to be fairly uniform throughout the downward stroke of the pushbutton 22.

When the pushbutton 22 is fully depressed, the upper end 46 of the spring 44 will have ridden along the cam surface 50 to substantially its outer end 52, at which time it will engage the contact portion 38 so as to complete the circuit between the contact members 28 and 30. When the downward pressure on the pushbutton 22 is released, the spring 44 will force the pushbutton 22 back to its original unactuated position. Thus, the spring 44 provides both the contact mechanism between the contact members 28 and 30 and also the return mechanism for the pushbutton 22. The bottom 48 of the pushbutton 22 is formed with a generally rectangular shape which is retained in the close fitting wall 49 of the cover 12 to prevent the pushbutton from rotating and to maintain alignment with the spring 44.

The contact portions 38 of the contact members 28 have V-shaped notches 54 in them. The V-shaped notch is advantageous in that it achieves contact redundancy by providing a minimum of two contact areas 56, 58. In addition, the multiple coils of the coil spring 44 also provide contact redundancy since several coils engage the contact portion 38 at one time, thereby improving reliability of the switch of the present invention. The contact members 28, 30 are preferably molded into the base 14, and they preferably have the circular protrusions 60 which extend from a widened end section 62 in order to retain the contact members 28, 30 more securely in the base. The indicating devices of the switch package of the illustrated embodiment are light-emitting diodes. The diodes 18 that are shown may be gallium arsenide phosphide, red light-emitting diodes. This type of diode may be purchased from a number of sources, including Hewlett-Packard, who sells the diode with a pair of leads 64, 66 that are shaped as shown in FIG. 8 (without the lead extensions 90, 98). The leads 64, 66 have a small gap 68 and then a larger gap 70 between them as they extend downwardly from the base 72 of the light-emitting diode 18. The surfaces 74, 76 where the small gap 68 joins the larger gap 70 preferably rest on the top surface 78 of an elongated rail 80 which is integrally formed on the base 14 and which runs substantially parallel to the edges 34, 40. The leads 64, 66 of commercially available diodes are generally too closely spaced together to provide the output connections for a dual-in-line switch package having standard lead spacings, but a number of presently available diodes can be employed in the present invention and, thus, the particular diode 18 and its leads 64, 66 may assume a variety of configurations within the scope of the present invention. Resistor light emitting diodes are also available, from Hewlett-Packard and others, in which a series resistor is built into a diode which has a configuration similar to that shown in the drawings. These resistor light-emitting diodes may alternately be used in the present invention so that the user may eliminate resistors on his mating circuit board.

The inside surfaces 82, 84 of the leads 64, 66 straddle the rail 80 and they may engage the outside surfaces 86, 88 of the rail 80 to assist in holding the diode 18 in place on the rail 80. The diodes 18 are held in place in the switch package 10 by entrapment when the cover 12 is snapped into place, thereby making replacement of the diodes very easy to accomplish since no permanent connection is made between the diodes 18 and the base 14.

In order to bring out the electrical connections to a light-emitting diode 18 to the edges 34, 40 of the switch package 10, a pair of lead extensions 90, 98 may be affixed by welding, soldering or other suitable means to the ends of the diode leads 64, 66, or alternately, the extension 90 may be integrally formed with the lead 64. The lead extension 90 has a curved segment 92 which allows the lower, or terminal, end of the lead extension 90 to be brought forward, slightly outward, and down through the opening 94, which has a widened mouth 96, near the edge 34 of the switch package 10. The lower surface 93 of the curved segment 92 preferably rest on the upper surface 95 of the base 14. A second lead extension 98 is secured to the end of the diode lead 66 or is integrally formed from the lead 66. The lead extension 98 has a first curved segment 100 which brings the lead extension 98 forward in line with the lead extension 90, and a second curved segment 102 which brings the lead extension 98 away from the rail 80 toward the edge 40. The lower surface 103 between the curved segments 100 and 102 preferably rest on the upper surface 105 of the base 14, thus, the surfaces 74, 76 of the leads 64, 66 and the surfaces 93, 103 of the lead extensions 90, 98 preferably rest on the supporting surfaces 78, 95 and 105 respectively. However, due to tolerances, only the surfaces 74, 76 may engage the surface 78, or alternately, the surfaces 93, 103 may engage the surfaces 95, 105. In either event, the diode will be firmly supported in the switch package. The lower, or terminal, end of the lead extension 98 passes through the opening 104, which has a widened mouth 106, near the edge 40 of the switch package 10. The lead extensions 90 and 98 are spaced so that their terminal or end portions alternate with the terminal end portions of the contact members 28, 30 near the edges 34, 40 of the elongated dimension of the switch package 10 as shown in the drawings.

An alternate version of a switch package 10' constructed in accordance with the present invention is shown in FIGS. 9–12. This switch package utilizes light indicators which are each connected in series with an associated switching mechanism, and this construction consequently allows for the elimination of one external switch contact member per switching stage. A larger number of switching stations and indicators may then be incorporated in the same size switching package as that shown in FIG. 1 without undue crowding.

The switch package of FIGS. 9–12 is in many respects constructed the same as the switch package shown in FIGS. 1–8. The component parts of the switch package of FIGS. 9–12 which correspond to similar parts of the switch package of FIGS. 1–8 are, therefore, labeled with the same element numbers, except that the numbers are primed in FIGS. 9–12. Because of the similar nature of these elements, the description previously given with respect to FIGS. 1–8 is applicable to these elements in FIGS. 9–12.

The main differences of the switch package of FIGS. 9–12 lie in the substitution of the contact member 28' for the contact member 28 of FIG. 1. The contact member 28' does not extend through the base 14', but instead it preferably is formed in a U-shaped manner with the bottom 33' of the U being molded in the base 14', and the two arms of the U forming contact portions 38', 29'. The first contact portion 38' is essentially the same as the contact portion 38 of FIG. 1 and it interacts with the spring 44' to complete the electrical current between the contact portion 38' and the contact portion 42' of the contact member 30'. The second contact portion 29' preferably runs along the surface 88' of the rail 80' and terminates in a bifurcated end with arms 41', 43' that have sloped sides 45', 47' that lead to the opening 49' which receives the bottom of the lead 66' of the light-emitting diode 18' so as to resiliently lock it into place and to make electrical connection thereto. Other suitable connections may be utilized within the scope of the present invention to contact the lead 66' and the contact member 28'.

Figure 9:
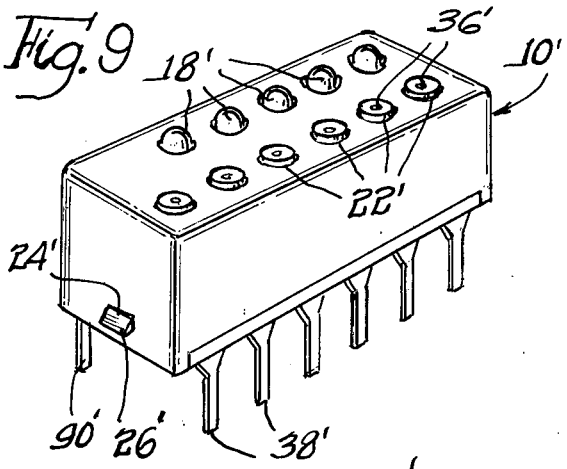
FIG. 9 is a perspective view of an alternate embodiment of a dual-in-line switch package which is constructed in accordance with the present invention.
Figure 10:
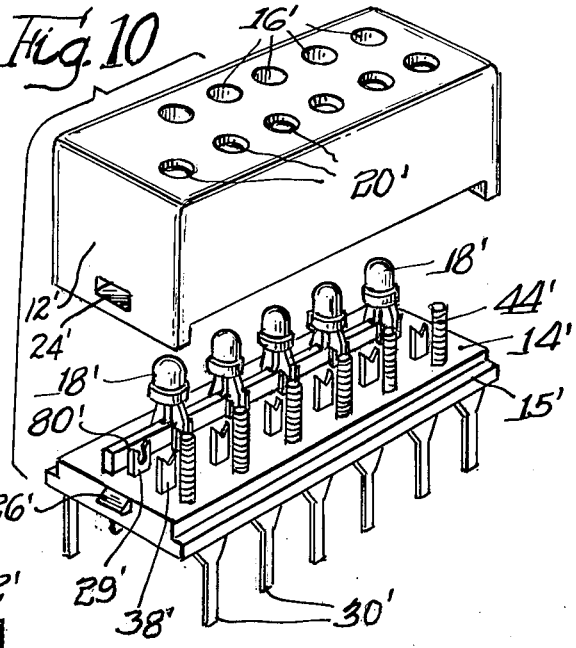
FIG. 10 is a perspective view of the switch package of FIG. 9 with the cover removed and the pushbuttons not shown.
Figure 11:
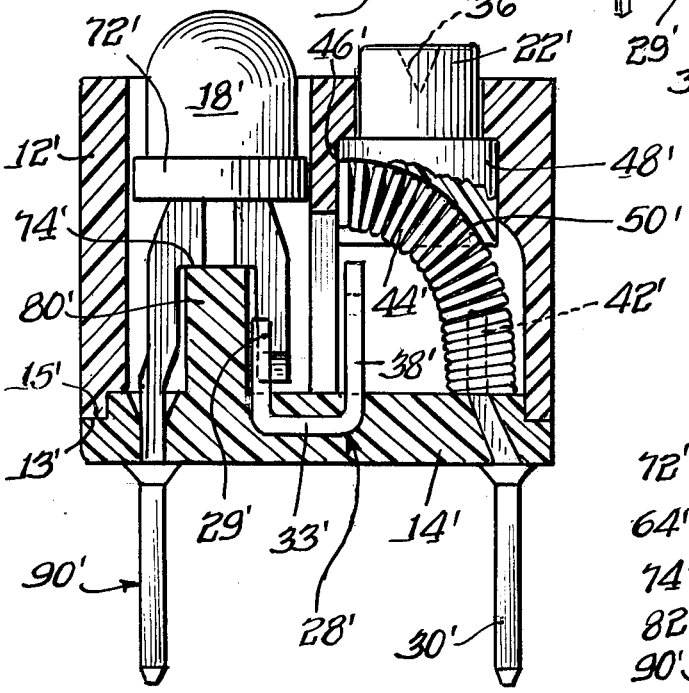
FIG. 11 is a cross-sectional view of a single switching mechanism and an indicating light of the switch package of FIG. 9.
Figure 12:
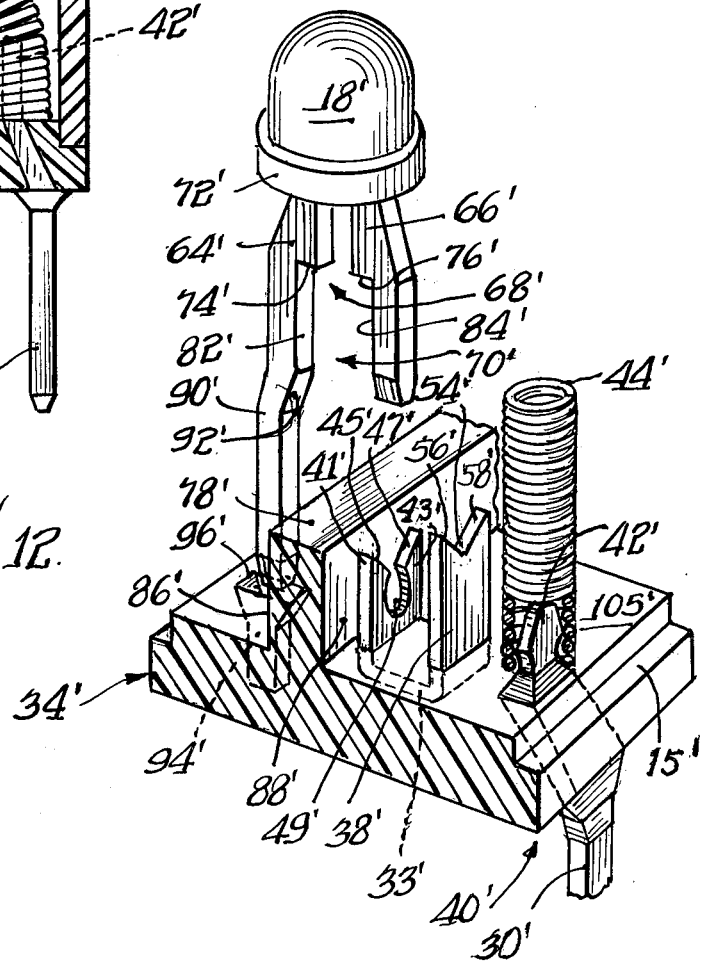
FIG. 12 is an enlarged perspective view that shows one light-emitting diode indicator that is supported on a rail which is integrally formed on the base of the switch package of FIG. 9.

In addition to the replacement of the contact member 28 with the contact member 28' other significant differences of the switch package of FIG. 9, with respect to the switch package of FIG. 1, reside in the position of the diodes 18' and of the shape of their leads. The diodes 18' of FIGS. 9–12 are positioned so they are substantially in line with the corresponding spring 44' and the corresponding contact portion 38'. The lead 66' of the diode 18' does not extend through the base 14', but the lead 64' has lead extension 90' that is integrally formed with the lead 64', or secured by suitable means to it, which has a curved segment 92' with a slight forward bend in it which allows the lead 64' to pass through the opening 94' which has the widened mouth 96'. The lead extensions 90', therefore, project through the base 14' along the edge 34', and they are the only leads which protrude near this edge. The contact members 30' project through the base 14' along the edge 40', and they are the only leads which protrude near this edge. The leads 30', 90' are, therefore, preferably substantially parallel in the embodiment of FIGS. 9–12.

The operation of the switch of FIGS. 9–12 is essentially the same as the operation of the switch of FIGS. 1–8 except that fewer external circuit board connectors are required to implement the switch package of FIGS. 9–12 because of the series connections of the diode indicator and the contact portion 44'. In addition, as previously mentioned, the alignment of the diode indicator 18' with the contact portion 38' eliminates the necessity of providing the alternating diode lead and contact member lead arrangement of FIG. 1.

What is claimed is:

1. An electrical switch mechanism comprising a horizontally disposed base, first and second spaced-apart contact members which extend vertically upward from said base, a wound coil spring, the lower portion of which is supported in a vertical manner by receipt of the upper portion of said first contact member inside the lowermost end coils of said spring so that the lowermost end coils of said spring encircle said upper portion of said first contact member, said coil spring being bent in a smooth arc that prevents buckling of said coil spring during operation of said switch, and a depressible actuating member which has a cam surface thereon which contacts and deflects the upper portion of said spring toward said second contact member to form said smooth arc so that said upper portion of said coil spring directly overlays but does not contact said second contact member when said actuating member is in its undepressed condition and which further deflects said upper portion of said coil spring downwardly into contact with said second contact member with the lowermost end coils of said coil spring continuing to encircle the upper portion of said first contact member when said actuating member is depressed, so that an electrical circuit between said first and second contact members is thereby made and said coil spring acts to return said actuating member to its initial undepressed position following the release of actuation pressure on said actuating member.

2. An electrical switch mechanism as claimed in claim 1 wherein said coil spring is a close wound spring and said base has a longitudinal rail thereon comprising an indicating means having an indicating portion and first and second contact leads which extend from said indicating portion, a first portion of each of said contact leads being adjacent to and supported by said rail due to straddling of said rail by said first portions of said contact leads, a second portion of each of said contact leads being constructed to increase the distance between the terminal end sections of said contact leads at points where the respective terminal ends extend through said base to form external connection leads for said switch mechanism.

3. An electrical switch mechanism as claimed in claim 1 wherein said spring is a close wound spring and said base has a longitudinal rail thereon comprising an indicating means having an indicating portion and first and second contact leads which extend from said indicating portion, a first portion of each of said contact leads being adjacent to and supported by said rail due to staddling of said rail by said first portions of said contact leads, a second portion of one of said contact leads being constructed to extend through said base to form an external connection for said switch mechanism and a second portion of the other of said contact leads being connected directly to said second contact member.

* * * * *